US011773764B1

(12) United States Patent
Engineer

(10) Patent No.: US 11,773,764 B1
(45) Date of Patent: Oct. 3, 2023

(54) PURGE DEVICE FOR PASSIVE OR ACTIVE PRECHAMBERS

(71) Applicant: ARAMCO SERVICES COMPANY, Houston, TX (US)

(72) Inventor: Nayan Engineer, Canton, MI (US)

(73) Assignee: SAUDI ARABIAN OIL COMPANY, Houston, TX (US)

( * ) Notice: Subject to any disclaimer, the term of this patent is extended or adjusted under 35 U.S.C. 154(b) by 0 days.

(21) Appl. No.: 18/147,565

(22) Filed: Dec. 28, 2022

(51) Int. Cl.

| | |
|---|---|
| ***F02B 19/10*** | (2006.01) |
| ***F02B 19/12*** | (2006.01) |
| ***F02F 1/42*** | (2006.01) |
| ***F02B 19/18*** | (2006.01) |

(52) U.S. Cl.
CPC ..... *F02B 19/108* (2013.01); *F02B 19/12* (2013.01); *F02B 19/18* (2013.01); *F02F 1/425* (2013.01)

(58) Field of Classification Search
CPC ..... F02B 19/108; F02B 19/12; F02B 19/18; F02B 19/1042; F02F 1/425
See application file for complete search history.

(56) References Cited

U.S. PATENT DOCUMENTS

| | | | | |
|---|---|---|---|---|
| 11,022,026 | B2 | 6/2021 | Kraemer et al. | |
| 11,333,061 | B1 * | 5/2022 | Zhang | F02B 21/00 |
| 2018/0066571 | A1 * | 3/2018 | Boyde | F02B 19/1023 |
| 2018/0135505 | A1 * | 5/2018 | Fuchs | F02D 41/0027 |
| 2018/0363539 | A1 * | 12/2018 | Shelby | F02B 19/12 |
| 2021/0003066 | A1 * | 1/2021 | Kraemer | F02B 19/18 |

FOREIGN PATENT DOCUMENTS

| | | | |
|---|---|---|---|
| CN | 113982739 | A | 1/2022 |

* cited by examiner

*Primary Examiner* — Xiao En Mo
(74) *Attorney, Agent, or Firm* — Osha Bergman Watanabe & Burton LLP

(57) ABSTRACT

A purge system includes a prechamber in fluid communication with a main chamber of an engine cylinder, and a port divider having a dividing wall that creates a plurality of passages within an intake port of the main chamber. The purge system further includes an outer tube fixed between a first passage of the port divider and the prechamber, and an inner tube rotatable within the outer tube. The outer tube includes apertures along a wall of the outer tube that fluidly connect the outer tube with the first passage of the port divider and with the prechamber. The inner tube includes slots along a wall of the inner tube that to fluidly connect the first passage of the port divider and the prechamber when the slots align with the apertures.

20 Claims, 6 Drawing Sheets

PURGE DEVICE FOR PASSIVE OR ACTIVE PRECHAMBERS

BACKGROUND

Internal combustion engines generally operate by combusting a fuel mixture within a combustion chamber, where the combustion of the fuel mixture forces movement of one or more components in the engine. A typical internal combustion engine includes multiple cylinders defining the combustion chambers within an engine block. To generate a combustion reaction, a fuel mixture is directed through an inlet valve into the cylinder and subsequently ignited. Within the cylinder, a combustion reaction actuates an internal piston, that acts on a crankshaft of the engine.

Combustion within a combustion chamber of an internal combustion engine may be generated using different mechanisms, such as using high pressure and/or high temperature conditions or using an ignition device. A common ignition device set up requires a continuous ignition source, or spark, to be produced such that combustion is created by sparking an air and fuel mixture in the combustion chamber of the engine. Conventionally, the spark is created by energizing a copper ignition rod and placing the energized ignition rod within a set distance to a grounded nickel or iridium plate, where the electrical difference between the energized ignition rod and the grounded plate creates a continuous spark. Alternatively, a portion of the air and fuel mixture may be ignited in a pre-combustion chamber (also referred to as a prechamber), where the air and fuel mixture is ignited, and the resulting combustion reaction is released into the main combustion chamber to ignite the remainder of the air and fuel mixture.

Prechambers are used to combust a small quantity of fuel and produce turbulent jets, which can be ejected into the main combustion chamber to initiate combustion of the air and fuel mixture within the main combustion chamber. The turbulent jets provide distributed ignition sites that enable high burn rates of the air and fuel mixture in the main combustion chamber. Prechamber combustion can improve engine efficiency and reduce emission by providing fast combustion, better dilution tolerance, and lower knock tendency.

SUMMARY

One or more embodiments of the present invention relate to a purge system including a prechamber in fluid communication with a main chamber of an engine cylinder, and a port divider having a dividing wall that creates a plurality of passages within an intake port of the main chamber. The purge system further includes an outer tube fixed between a first passage of the port divider and the prechamber, and an inner tube rotatable within the outer tube. The outer tube includes apertures along a wall of the outer tube that fluidly connect the outer tube with the first passage of the port divider and with the prechamber. The inner tube includes slots along a wall of the inner tube that to fluidly connect the first passage of the port divider and the prechamber when the slots align with the apertures.

One or more embodiments of the present invention relate to a method including rotating an inner tube within an outer tube fixed between a prechamber in fluid communication with a main chamber of an engine cylinder, and a port divider including a dividing wall that creates a plurality of passages within an intake port of the main chamber. The method further includes aligning slots of the inner tube with apertures of the outer tube, thereby fluidly connecting a first passage of the port divider and the prechamber. In addition, the method includes purging the prechamber by transporting fluid from an intake port of the main chamber to the prechamber through the first passage of the port divider and misaligning the slots of the inner tube and the apertures of the outer tube by rotating the inner tube within the outer tube, thereby preventing the fluid from entering the prechamber.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In addition, throughout the application, the terms "upper" and "lower" may be used to describe the position of an element in a well. In this respect, the term "upper" denotes an element disposed vertically above a corresponding "lower" element relative to an engine, while the term "lower" conversely describes an element disposed vertically below a corresponding "upper" element. Likewise, the term "axial" refers to a direction substantially parallel to the primary extension direction of a component, while the term "radial" refers to a direction orthogonal to an axial direction.

In one or more embodiments, this disclosure describes systems and methods for purging a prechamber of a purge system. In one or more embodiments, the purge system includes a prechamber, a port divider, an outer tube, and an inner tube. The techniques discussed in this disclosure are beneficial in preventing misfire conditions within an engine. Further, the techniques discussed in this disclosure are beneficial as the purge system operates at each cylinder of a multi-cylinder internal combustion engine. In addition, the techniques discussed in this disclosure advantageously incur minimal pumping or frictional penalties, therefore increasing the efficiency of the engine. Moreover, the techniques discussed in this disclosure permit the purging of the prechamber to be controlled.

Figure 1:
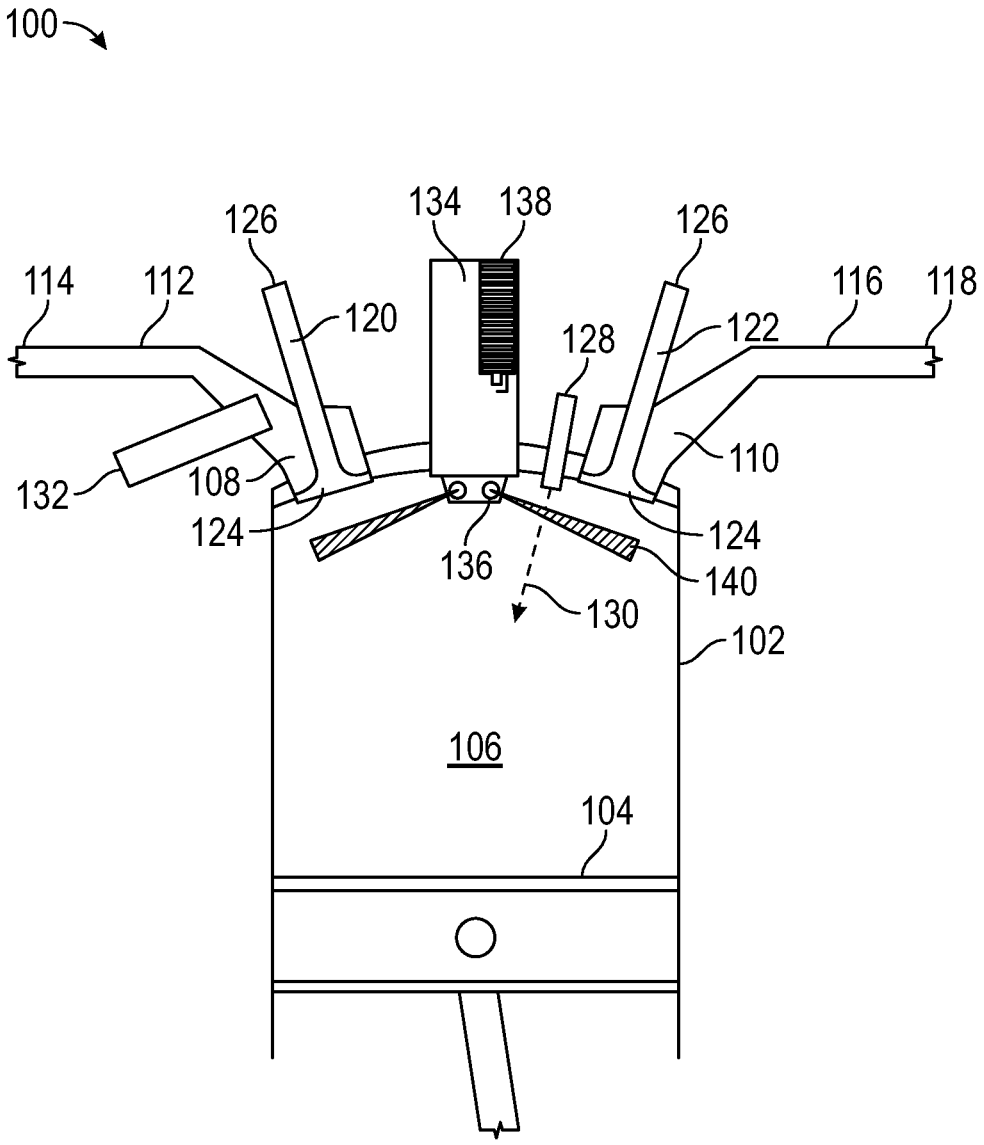
FIG. 1 shows an exemplary engine in accordance with one or more embodiments.

FIG. 1 shows an exemplary engine (100) in accordance with one or more embodiments. The engine (100) includes an engine cylinder (102) formed within an engine body or engine block. For ease of illustration, the engine (100) is shown with a single engine cylinder (102). However, the engine (100) is not limited to a single cylinder and may have multiple cylinders. For example, the engine (100) may include 1-16 cylinders arranged inline, in a v-shape, or in a flat-plane. A piston (104) is arranged to move back and forth within the engine cylinder (102). The piston (104) is connected to a crankshaft (not shown), which converts a reciprocating motion of piston (104) into rotary motion, as is well known in the art of reciprocating internal combustion engines (100). Components of FIG. 1 may be formed of aluminum, iron, steel, or equivalent metals used in conventional engine design known to a person of ordinary skill in the art.

A combustion chamber, hereon referred to as a main chamber (106), is defined within the engine cylinder (102). The volume of the main chamber (106) is dependent upon the position of the piston (104) within the engine cylinder (102). A head of the engine cylinder (102) includes at least one intake port (108) and at least one exhaust port (110). The intake port (108) is in fluid communication with an intake line (112). The intake line (112) includes an inlet (114) that receives air from the ambient environment. The intake line (112) forms one branch of an intake manifold (not shown), which may connect to a charged air cooler, a throttle, a fuel injector, an Exhaust Gas Regulation (EGR) system, or other components that regulate and/or change the physical properties of the intake air.

In one or more embodiments, the intake line (112) of the engine (100) may be connected to a forced induction system (not shown) such as a supercharger or turbocharger system. As is commonly known in the art, superchargers employ rotational energy provided by the engine (100) to rotate one or more compressors. The compressors are designed to increase the pressure of the air intake, and thus increase the amount of air in the engine (100) for combustion with fuel. Turbochargers operate similarly, however, the rotational energy of the turbocharger is provided by an exhaust gas that rotates a turbine attached to a compressor. The compressor receives ambient air and feeds the air into the engine (100) at a higher pressure. In embodiments which utilize a supercharger or turbocharger system, an air filter may be placed upstream of an inlet end of the compressor.

After the combustion reaction occurs, combustion byproducts such as unburned hydrocarbons, carbon monoxide, and similar byproducts are transferred out of the engine (100) with exhaust ports (110). As shown in FIG. 1, the exhaust port (110) of the engine cylinder (102) is in fluid communication with an exhaust line (116) that has an outlet (118) at its distal end relative to the engine (100). The outlet (118) serves to discharge exhaust gases to the ambient environment. The exhaust line (116) may further connect to an exhaust emission control device (e.g., a catalytic converter) that reduces toxic gases and pollutants found in the exhaust gases from being discharged to the ambient environment. Finally, similar to the intake line (112), the exhaust line (116) shown in FIG. 1 forms one branch of an exhaust manifold (not shown).

Further, an intake valve (120) is located at each intake port (108) to control flow from the intake line (112) to the main chamber (106). Similarly, each exhaust port (110) includes an exhaust valve (122) that controls flow from the main chamber (106) to the exhaust line (116). The intake valve (120) and the exhaust valve (122) are shaped with a head portion (124) that covers the intake port (108) and the exhaust port (110), respectively, and a valve stem (126) that is directly or indirectly actuated by a camshaft (not shown). In one or more embodiments, the engine (100) may be a four-valve per cylinder type engine (100) with two intake valves (120) and two exhaust valves (122). Alternatively, the engine (100) may be a two-valve design, with a single intake valve (120) and a single exhaust valve (122), or any number of valves associated therewith. As such, the number of valves is not considered to be limited to a specific number thereof.

In typical operations, a direct injection fuel injector (128) is positioned along the engine cylinder (102) to inject a plurality of fuel streams (130) into the main chamber (106). In the alternative, a port fuel injector (132) may be positioned within the intake port (108) to inject fuel into the air flowing into the intake port (108) from the intake line (112). Furthermore, in some embodiments, both a direct injection fuel injector (128) and a port fuel injector (132) may be employed.

Fuel is injected by the direct injection fuel injector (128) into the main chamber (106) at high pressures to encourage atomization of the fuel in the air that is present within the main chamber (106). Atomization of the fuel enhances combustion efficiency of the engine (100) and may decrease formation of particulate matter emissions, as well as NOx and carbon monoxide, when the air and fuel mixture is combusted. Such is due to the fact that the atomized fuel combusts more completely than its non-atomized counterpart and burns for a shorter duration overall. The complete combustion afforded by the atomization process further encourages a reduction in the amount of unreacted hydrocarbons exiting the engine (100) during an exhaust stroke.

As its operating configuration, the piston (104) of the engine cylinder (102) is actuated according to a four-stroke cycle including an intake stroke, a compression stroke, a power stroke, and an exhaust stroke. During the intake stroke, the intake valve (120) is open, the exhaust valve (122) is closed, and air is drawn into the main chamber (106) by lowering the piston (104). During the compression stroke, the intake valve (120) and exhaust valve (122) are closed, and the air in the main chamber (106) is compressed by the piston (104). Fuel and air are also injected into a prechamber (134) that is in fluid communication with the main chamber (106) at this time.

The prechamber (134), in accordance with one or more embodiments, is formed with a smaller volume than the main chamber (106). For example, in one or more embodiments, the prechamber (134) has a volume between 0.5 cubic centimeters and 3 cubic centimeters, inclusive, while the main chamber (106) has a displacement volume greater than 300 cubic centimeters. In addition, the prechamber (134) includes a plurality of nozzles (136) integrally formed through a wall of the prechamber (134). The nozzles (136) fluidly connect the prechamber (134) and the main chamber (106), and the nozzles (136) serve to accelerate and atomize fuel as it passes from the main chamber (106) to the prechamber (134). The fuel is forced through the nozzles (136) with a compression force created by the piston (104) during compression strokes.

As shown in FIG. 1, a spark plug (138) is connected to and configured to interface with the prechamber (134). During the end of the compression stroke, or during a late portion of the compression stroke, the direct injection fuel injector (128) injects fuel into the main chamber (106) and the spark plug (138) in the prechamber (134) ignites the air and fuel mixture disposed in the prechamber (134). The ignition of the mixture produces multiple hot jets (140) that exit the prechamber (134) through the nozzles (136) into the main chamber (106). The hot jets (140) transfer their combustion heat energy to the fuel stream (130) of the main chamber (106), which initiates combustion in the main chamber (106).

During the power stroke, the high-pressure gases produced from the combustion of the air and fuel mixture in the main chamber (106) expand and push the piston (104) downwards, generating a force on the crankshaft. Further, during the power stroke, the intake valve (120) and the exhaust valve (122) are both closed to prevent the combustion reaction from entering the intake line (112) and the exhaust line (116). The timing of opening and closing of the intake valve (120) and exhaust valve (122) may be controlled by either a timing chain (not shown) coupled to the camshaft, or controlled by a computer or Electronic Control Module (ECM) if the intake valve (120) and exhaust valve (122) are electronically timed. Similarly, the operation of the direct injection fuel injector (128) during the various strokes may be controlled by a computer or ECM, or by a timing chain.

Subsequent to the power stroke, the exhaust stroke begins, and the exhaust valve (122) is opened. The piston (104) is actuated by the crankshaft, which causes the exhaust gases to be pushed out of the exhaust valve (122). At the end of the exhaust stroke the exhaust valve (122) is closed and the intake valve (120) is opened, thereby starting the next intake stroke as the piston (104) actuates to expand the volume of the main chamber (106).

In one or more embodiments, as discussed above, the prechamber (134) may be passively fueled by precisely aligning the fuel stream (130) of the direct injection fuel injector (128) with a nozzle (136) of the prechamber (134). In other embodiments, the prechamber (134) may be passively fueled by rebounding fuel streams (130), which may be initially produced by the direct injection fuel injector (128) and may rebound or otherwise diffuse throughout the main chamber (106) to subsequently enter a nozzle (136) of the prechamber (134). Further, in one or more embodiments, the prechamber (134) may be actively fueled by using a prechamber fuel injector (FIG. 2) disposed within the prechamber (134). Accordingly, the prechamber (134) may be fueled either actively or passively, in any manner or configuration, without departing from the scope of this disclosure.

Figure 2:
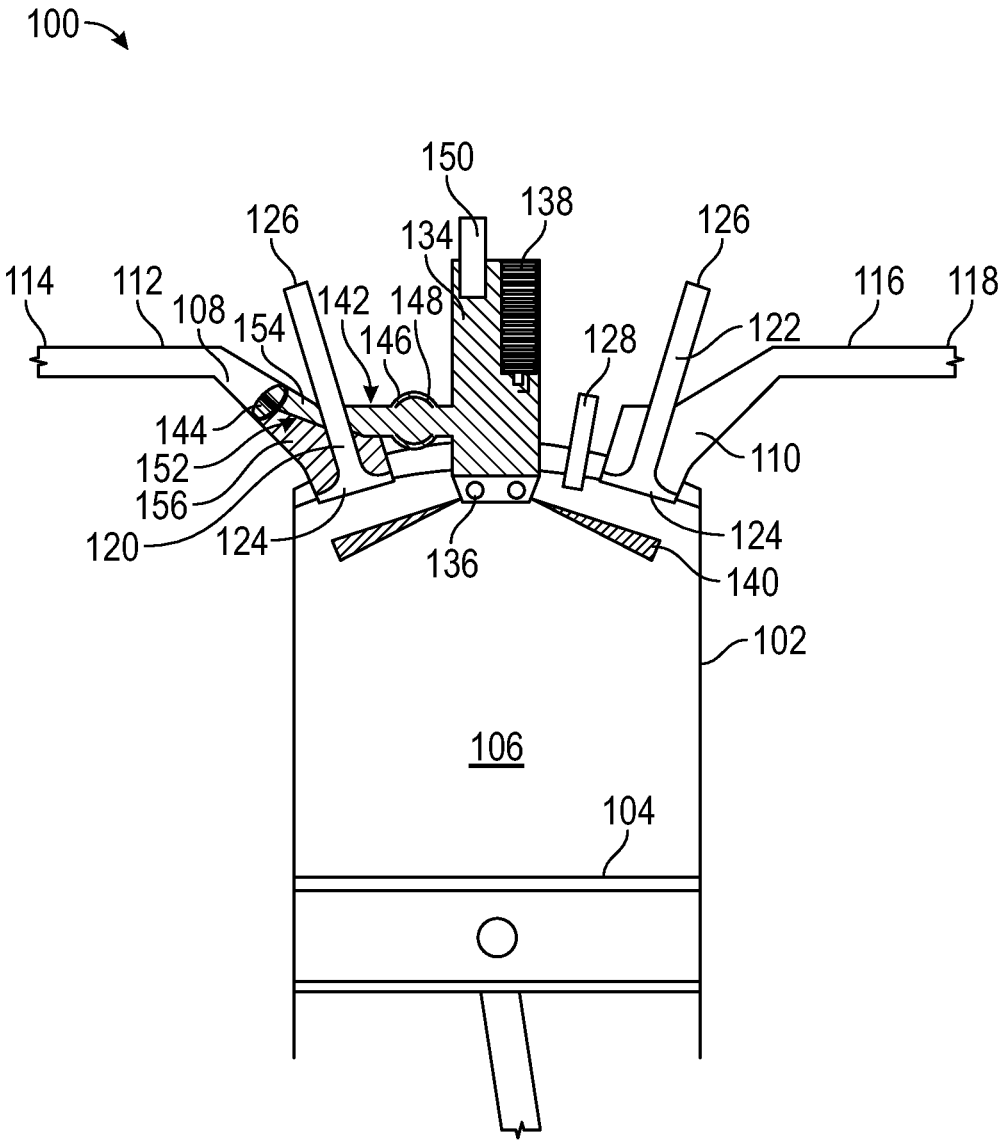
FIG. 2 shows an engine including a purge system in accordance with one or more embodiments.

FIG. 2 shows an engine (100) including a purge system (142) in accordance with one or more embodiments. Components shown in FIG. 2 that have been described in FIG. 1 have not been redescribed for purposes of readability and have the same description and purpose as outlined above.

The purge system (142) includes a prechamber (134), a port divider (144), an outer tube (146), and an inner tube (148). The purge system (142) serves to purge the prechamber (134) with fresh air or another fluid in order to remove residual gases within the prechamber (134) from previous cycles of the engine cylinder (102). Further, the purge system (142) actively controls the purging of prechamber (134) by controlling both when a purge of the prechamber (134) occurs and when the purge of the prechamber (134) is complete.

Similar to the prechamber (134) described in FIG. 1, the prechamber (134) of the purge system (142) is in fluid communication with a main chamber (106) of an engine cylinder (102). Here, the prechamber (134) is an active prechamber (134) and includes a spark plug (138) and a prechamber fuel injector (150). However, the prechamber (134) may be a passive prechamber (134), as depicted in FIG. 1, where the prechamber (134) does not include a prechamber fuel injector (150). Instead, a port fuel injector (132) may be disposed along the intake port (108). The prechamber (134) is situated at an upper end of the main chamber (106) and is depicted as having a volume smaller than a volume of the main chamber (106). In addition, the prechamber (134) includes a plurality of nozzles (136) integrally formed through a wall of the prechamber (134) that fluidly connect the prechamber (134) and the main chamber (106) as described above.

The port divider (144) of the purge system (142) is fluidly connected to the intake port (108) of the engine cylinder (102). The port divider (144) includes an opening for receiving a fluid within the intake port (108) and a dividing wall (152) that creates a plurality of passages for the fluid to travel within the port divider (144). In FIG. 2, the dividing wall (152) of the port divider (144) creates a first passage (154) between the opening of the port divider (144) and the prechamber (134). The first passage (154) fluidly connects the prechamber (134) and the intake port (108). In addition, the dividing wall (152) of the port divider (144) creates a second passage (156) between the opening of the port divider (144) and the main chamber (106). In this way, the second passage (156) fluidly connects the intake port (108) and the main chamber (106). The port divider (144), along with the dividing wall (152), may be formed of an aluminum casting or another durable and heat resistant material. Further, the port divider (144) may be casted integrally with the intake port (108) and/or the prechamber (134).

Disposed along the first passage (154) of the port divider (144) is an outer tube (146). The outer tube (146) is a fixed shaft that is situated outside of the engine cylinder (102), including outside of the intake port (108) and the prechamber (134). In relation to the perspective view of FIG. 2, the outer tube (146) extends perpendicular to the first passage (154) of the port divider (144) such that the outer tube (146) intersects the first passage (154) of the port divider (144). In addition, the outer tube (146) includes apertures (158) along a wall (160) of the outer tube (146). The apertures (158) provide fluid communication between the outer tube (146) and the first passage (154) of the port divider (144), as well as fluid communication between the outer tube (146) and the prechamber (134). The outer tube (146) may be formed of aluminum, steel, or another durable and heat resistant material.

The inner tube (148) of the purge system (142) is a rotatable shaft disposed within the outer tube (146) Similar to the outer tube (146), the inner tube (148) may be formed of aluminum, steel, or another durable and heat resistant material and includes slots (162) along a wall (164) of the inner tube (148). The slots (162) of the inner tube (148) are sized and shaped to substantially match the apertures (158) of the outer tube (146). As such, the slots (162) fluidly connect the first passage (154) of the port divider (144) and the prechamber (134) when the slots (162) are aligned with the apertures (158). However, when the inner tube (148) has been rotated such that the slots (162) of the inner tube (148) are misaligned with the apertures (158) of the rotationally fixed outer tube (146), fluid communication between the first passage (154) of the port divider (144) and the prechamber (134) is lost. The rotation of the inner tube (148) may be controlled by a camshaft assembly (FIG. 4) of the engine (100). Alternatively, the rotation of the inner tube (148) may be controlled by an electric motor (FIG. 5).

Figure 3A:
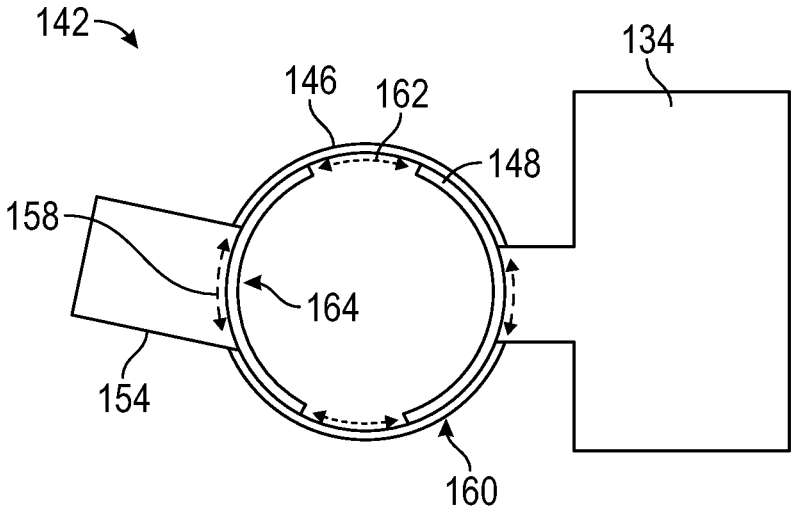
FIGS. 3A and 3B depict an operational sequence of the purge system in accordance with one or more embodiments.
Figure 3B:
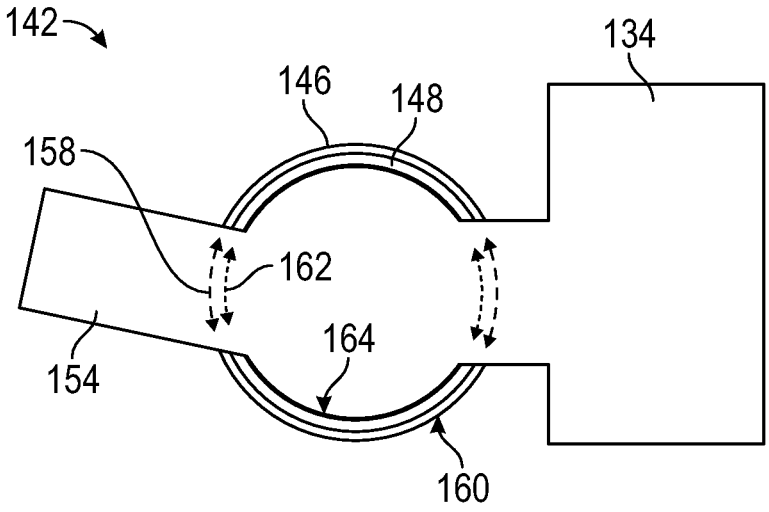

FIGS. 3A and 3B illustrate an operational sequence of a purge system (142) in accordance with one or more embodiments of the invention. Specifically, FIG. 3A depicts the purge system (142) during the compression stroke and the power stroke. During these strokes of the engine cylinder (102), the inner tube (148) is positioned such that the slots (162) of the inner tube (148) do not align with the apertures (158) of the outer tube (146). Consequently, the wall (164) of the inner tube (148) blocks fluid from traveling through the apertures (158) of the outer tube (146), and therefore prevents fluid from traveling from the first passage (154) of the port divider (144). Further, a seal (not shown) or a plurality of seals, formed of rubber or an elastomer, may be positioned between the inner tube (148) and the outer tube (146) in order to prevent fluid from entering a space disposed between the inner tube (148) and the outer tube (146) when the slots (162) and apertures (158) are misaligned. In this way, the seals prevent fluid from escaping the engine cylinder (102).

During the latter half of the exhaust stroke or at any time during the intake stroke, the inner tube (148) may be rotated within the outer tube (146) such that the slots (162) and the apertures (158) are aligned, as shown in FIG. 3B. In this position, the prechamber (134) and the first passage (154) of the port divider (144) are in fluid communication. Thus, the prechamber (134) and the intake port (108) are also in fluid communication.

When the slots (162) and apertures (158) align within the purge system (142), fluid within the intake port (108) is transported through the first passage (154) of the port divider (144) into the prechamber (134), thereby purging the prechamber (134). During a purge event, or the purge of the prechamber (134), fluid (such as air) from the intake port (108) fills the prechamber (134) and residual gases within the prechamber (134) from previous cycles are forced to exit the prechamber (134) through the nozzles (136) of the prechamber (134). Specifically, if the inlet (114) is connected to a pressurized fluid source, such as air from a forced induction system, the pressure differential between the main chamber (106), which has low fluid pressure, and the inlet (114), which has high fluid pressure, causes the fluid to be drawn through the prechamber (134). Alternatively, or additionally, the fluid may be drawn into the prechamber (134) by lowering the piston (104) through the cylinder, which creates a low pressure region in the main chamber (106), thereby generating a pressure differential that draws air through the prechamber (134). In this way, the residual gases travel from the prechamber (134) to the main chamber (106) during a purging event.

Since the purging of the prechamber (134) of the purge system (142) is timed by the rotatable inner tube (148), pressure imbalances within the engine cylinder (102), and thus backflow of fluid into the intake port (108), may be prevented. Furthermore, the position of the inner tube (148) during the power stroke and the combustion stroke, as depicted in FIG. 3A, prevents backflow of combustion gases into the intake port (108). Further, when using boosted air to purge the prechamber (134), no additional work is required to pressurize the air, and thus parasitic losses commonly incurred by an engine (100) may be reduced. In turn, engine efficiency increases from the reduction of parasitic losses.

Figure 4:
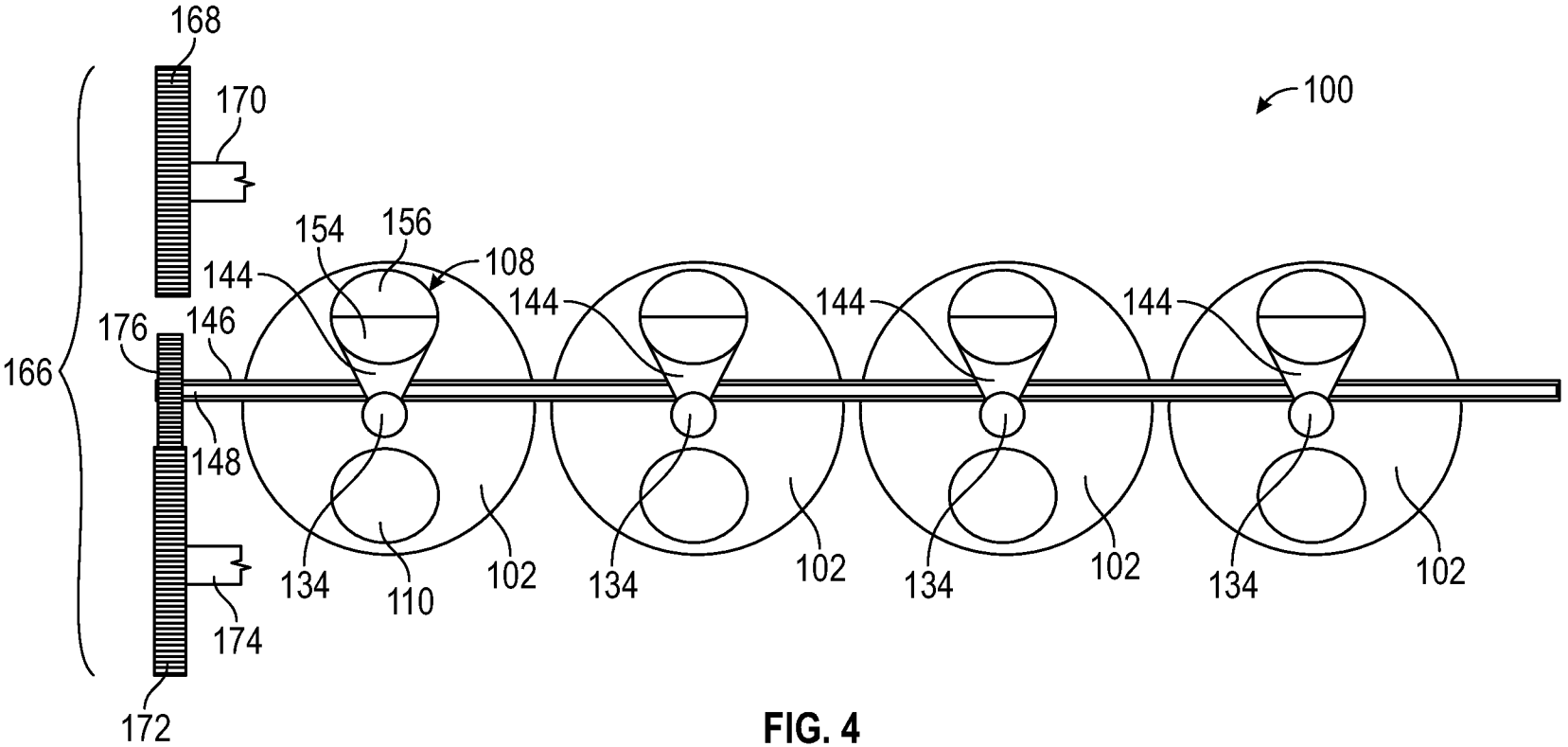
FIG. 4 shows an engine including a plurality of purge systems in accordance with one or more embodiments.
Figure 5:
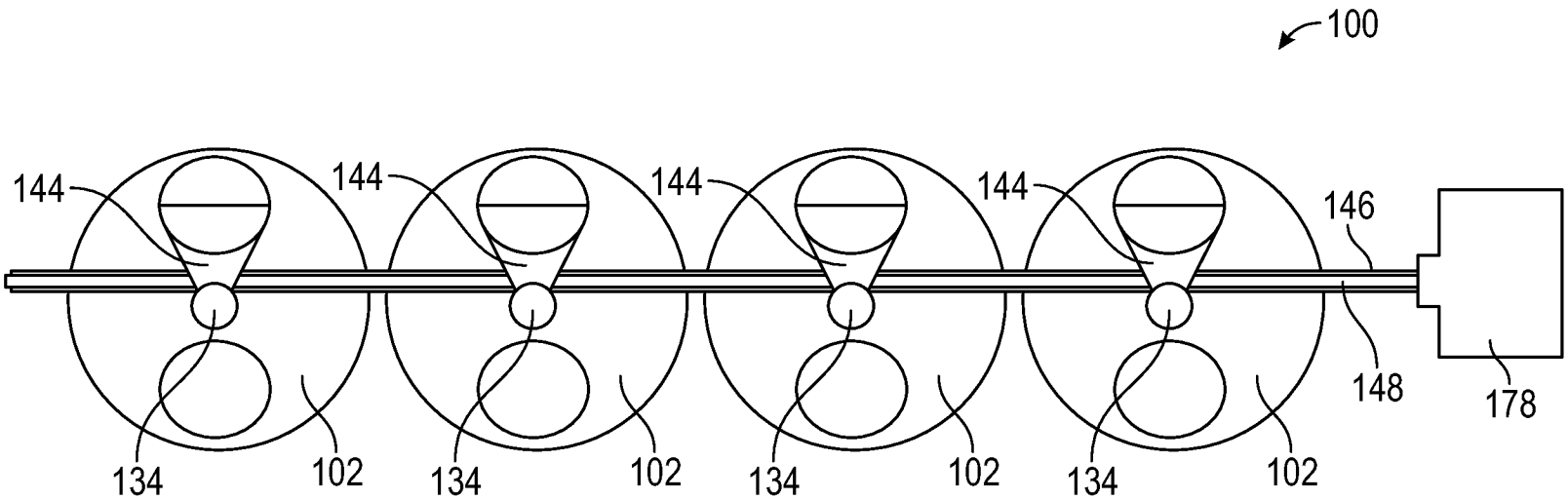
FIG. 5 shows an engine including a plurality of purge systems in accordance with one or more embodiments.

FIG. 4 depicts an engine (100) including a plurality of purge systems (142) in accordance with one or more embodiments. A plurality of purge systems (142) may be integrated into a multi-cylinder internal combustion engine (100). In this particular embodiment, the plurality of purge systems (142) are incorporated within a four-cylinder engine (100). Further, in this particular embodiment, a port divider (144) and a pre chamber are located at each engine cylinder (102), while a single outer tube (146) and a single inner tube (148) are utilized across each of the engine cylinders (102). In additional embodiments, each purge system (142) of the plurality of purge systems (142) may include separate outer tubes (146) that share a common inner tube (148).

Furthermore, in this particular embodiment, the purge system (142) is timed by a camshaft assembly (166) of the engine (100). Specifically, the rotation of the inner tube (148) of the plurality of purge systems (142) within the outer tube (146) of the plurality of purge systems (142) is controlled such that the slots (162) and the apertures (158) align during the end of the exhaust stroke or during the intake stroke. As described above, the rotation of the inner within the outer tube (146) is controlled such that the slots (162) and the apertures (158) are misaligned during the combustion stroke and the power stroke.

As commonly known in the art, the camshaft assembly (166) includes an intake camshaft sprocket (168), an intake camshaft (170), an exhaust camshaft sprocket (172), and an exhaust camshaft (174). The intake camshaft sprocket (168) and the exhaust camshaft sprocket (172) are connected with a timing chain that mechanically couples the actuation of the intake camshaft (170) to the exhaust camshaft (174). The timing chain further synchronizes the rotation of the intake camshaft (170), the exhaust camshaft (174), and the crankshaft of an engine (100), thereby ensuring proper timing of the actuation of intake valves (120) and the exhaust valves (122). In this way, the intake valves (120) and the exhaust valves (122) are timed to open and close according to the firing of each engine cylinder (102) to facilitate the combustion process.

As shown in FIG. 4, the camshaft assembly (166) further includes a purge sprocket that is embodied as an epicyclic drivetrain (176). The epicyclic drivetrain (176), as commonly known in the art, may include a ring gear, a sun gear, a plurality of planet gears, and a planet carrier. Further, the epicyclic drivetrain (176) may be driven by either the intake camshaft sprocket (168) or the exhaust camshaft sprocket (172). The inner tube (148) is coupled to the camshaft assembly (166) by the epicyclic drivetrain (176), causing the actuation of the inner tube (148) to be coupled to the remainder of the camshaft assembly (166). The arrangement of the camshaft assembly (166) and the epicyclic drivetrain (176) provides a speed reduction to prevent undue wear and properly time the rotation of the inner tube (148).

Alternatively, in some embodiments, the rotation of the inner tube (148) may be timed and actuated by an electric motor (178), as depicted in FIG. 5. The electric motor (178) may be a DC motor or an AC motor that is powered by the electrical system of the vehicle. The electric motor (178) may be controlled by a computer or ECM as described above. As the electric motor (178) is not mechanically connected to the intake camshaft (170) or the exhaust camshaft (174), the electric motor (178) controls the rotation of the inner tube (148) within the outer tube (146) independent of the camshaft assembly (166) and the crankshaft of the engine (100). In this embodiment, the outer tube (146) is fixed to a casing of the electric motor (178) and/or to each port divider (144) of the plurality of purge systems (142).

Figure 6:
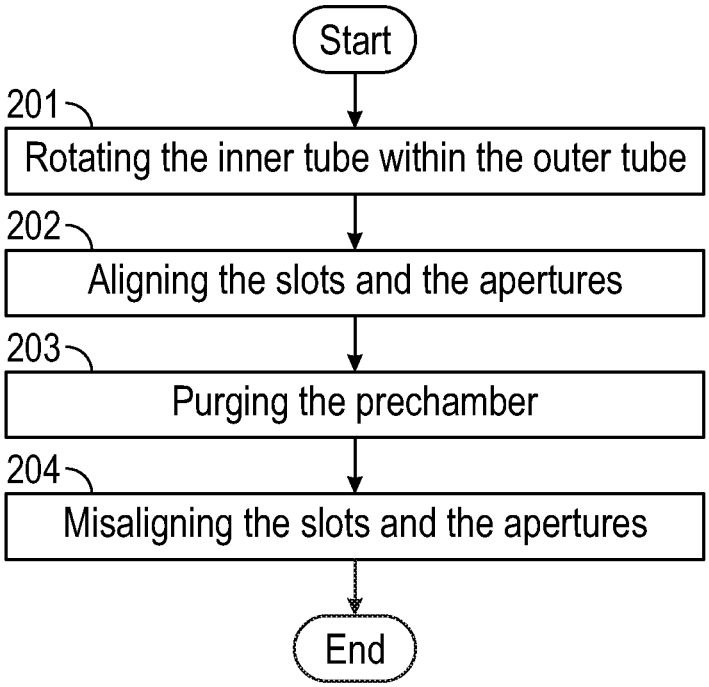
FIG. 6 shows a flowchart of a method in accordance with one or more embodiments of the present disclosure.

FIG. 6 shows a flowchart of a method in accordance with one or more embodiments of the present disclosure. While the various flowchart blocks in FIG. 6 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In block 201, an inner tube (148) of a purge system (142) is rotated within an outer tube (146) of the purge system (142). The outer tube (146) of the purge system (142) is disposed between a prechamber (134) and a port divider (144). The prechamber (134) is fluidly connected to the main chamber (106) with a plurality of nozzles (136) of the prechamber (134). The port divider (144) creates a first passage (154) fluidly connecting the intake port (108) and the prechamber (134) and a second passage (156) fluidly connecting the intake port (108) and the main chamber (106). Fluid within the first passage (154) and within the second passage (156) are isolated from each other by a dividing wall (152) of the port divider (144).

The rotation of the inner tube (148) may be actuated by the camshaft assembly (166) of the engine (100). To actuate the inner tube (148) with the camshaft assembly (166), the camshaft assembly (166) includes an epicyclic drivetrain (176) that is fixed to the inner tube (148) such that the rotational speed of the inner tube (148) corresponds to cycles of the engine cylinder (102). Alternatively, the rotation of the inner tube (148) may be regulated independently by an electric motor (178) that is controlled by a computer or ECM.

In block 202, at slots (162) of the inner tube (148) and apertures (158) of the outer tube (146) are aligned by the rotation of the inner tube (148) within the outer tube (146). Block 202 may occur during the end of the exhaust stroke or during the intake stroke of the engine cylinder (102). Fluid communication between the prechamber (134) and the first passage (154) of the port divider (144) is established due to the alignment of the slots (162) and the apertures (158). As a result, fluid is permitted to move from the intake port (108) to the prechamber (134).

In block 203, subsequent to the slots (162) and the apertures (158) aligning, the prechamber (134) of the purge system (142) is purged. Purging the prechamber (134) includes transporting fluid from the intake port (108) into the prechamber (134) in order to remove residual gases disposed in the prechamber (134) from previous cycles of the engine cylinder (102). In one or more embodiments, the prechamber (134) may be purged subsequent to the exhaust stroke due to a pressure differential between the intake port (108), the prechamber (134), and the main chamber (106) as described above. During a purge event of the prechamber (134), fluid travels from the intake port (108), into the first passage (154) of the port divider (144), through the apertures (158) and slots (162), and into the prechamber (134). Consequently, upon fluid entering the prechamber (134) from the intake port (108), the residual gas disposed within the prechamber (134) is forced to diffuse from the prechamber (134) and is replaced with fluid from the intake port (108). The residual gas exits the prechamber (134) through the nozzles (136) of the prechamber (134) into the main chamber (106) of the engine cylinder (102).

In block 204, subsequent to the purging of the prechamber (134), the inner tube (148) is rotated within the outer tube (146) such that the slots (162) and apertures (158) are misaligned. In this way, fluid communication between the intake port (108) and the prechamber (134) is lost. Specifically, the wall (164) of the inner tube (148) prevents fluid from passing through the apertures (158) of the outer tube (146) when the slots (162) and the apertures (158) are misaligned. The slots (162) and the apertures (158) are timed to be misaligned during the compression stroke and power stroke of the engine cylinder (102) by the camshaft assembly (166) or by the electric motor (178).

During the compression stroke, fuel may be injected into the prechamber (134). The prechamber (134) of the purge system (142) is embodied as either an active prechamber (134) or a passive prechamber (134). If the prechamber (134) is an active prechamber (134), fuel is supplied to the prechamber (134) by a prechamber fuel injector (150) disposed within the prechamber (134). Alternatively, if the prechamber (134) is a passive prechamber (134), fuel may be supplied to the prechamber (134) by a direct injection fuel injector (128) or by a port fuel injector (132).

Subsequently, a spark plug (138) of the prechamber (134) ignites fluid disposed within the prechamber (134). In turn, hot jets (140) are produced, and the hot jets (140) exit the prechamber (134) through the nozzles (136) into the main chamber (106). The hot jets (140) raise the temperature of a fuel stream (130) in the main chamber (106), thereby initiating combustion in the main chamber (106) and starting the power stroke.

Accordingly, the aforementioned embodiments as disclosed relate to purge systems (142) and methods useful for purging a prechamber (134) of the purge system (142). The aforementioned embodiments may be employed to purge an active prechamber (134) or a passive prechamber (134). Advantageously, the disclosed systems (142) and methods may utilize available boosted air and/or exhaust gas recirculation from an intake port (108) of the engine cylinder (102) to help purge the prechamber (134), thereby increasing engine efficiency as minimal pumping or frictional penalties are incurred within the intake port (108). Further, the disclosed systems (142) and methods advantageously regulate the timing of the prechamber (134) purging by regulating a rotation of an inner tube (148) within an outer tube (146) of the purge system (142) such that purge events occurs during the end of an exhaust stroke or during an intake stroke of an engine cycle. In this way, pressure imbalances are prevented, which prevents backflow of fluid into the intake port (108) of the engine cylinder (102). In addition, the disclosed systems (142) and methods may be incorporated across multi-cylinder internal combustion engines (100).

Although only a few embodiments of the invention have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A purge system comprising:

a prechamber in fluid communication with a main chamber of an engine cylinder, the main chamber comprising an intake port;

a port divider comprising a dividing wall configured to create a plurality of passages within the intake port;

an outer tube fixed between a first passage of the port divider and the prechamber, the outer tube including apertures along a wall of the outer tube configured to fluidly connect the outer tube with the first passage of the port divider and with the prechamber; and an inner tube rotatable within the outer tube, the inner tube comprising slots along a wall of the inner tube configured to fluidly connect the first passage of the port divider and the prechamber when the slots align with the apertures.

2. The purge system according to claim 1, wherein the wall of the inner tube prevents fluid from entering the prechamber through the first passage when the slots of the inner tube are misaligned with the apertures of the outer tube.

3. The purge system according to claim 1, wherein the first passage of the port divider fluidly connects the intake port and the prechamber.

4. The purge system according to claim 1, wherein rotation of the inner tube is controlled such that the slots of the inner tube align with the apertures of the outer tube during an intake stroke of the engine cylinder.

5. The purge system according to claim 1, wherein rotation of the inner tube is controlled such that the slots of the inner tube are misaligned with the apertures of the outer tube during a compression stroke of the engine cylinder.

6. The purge system according to claim 1, wherein rotation of the inner tube is controlled such that the slots of the inner tube are misaligned with the apertures of the outer tube during a power stroke of the engine cylinder.

7. The purge system according to claim 1, wherein rotation of the inner tube is controlled by a camshaft assembly.

8. The purge system according to claim 1, wherein rotation of the inner tube is controlled by an electric motor.

9. The purge system according to claim 1, wherein the prechamber comprises a spark plug.

10. The purge system according to claim 1, wherein the prechamber is fluidly connected to the main chamber by a plurality of nozzles.

11. The purge system according to claim 3, wherein a second passage of the port divider fluidly connects the intake port and the main chamber.

12. The purge system according to claim 7, wherein the inner tube is coupled to the camshaft assembly by an epicyclic drivetrain to control a rotational speed of the inner tube.

13. The purge system according to claim 9, wherein the prechamber further comprises a prechamber fuel injector.

14. A method comprising:

rotating an inner tube within an outer tube, the outer tube fixed between a prechamber in fluid communication with a main chamber of an engine cylinder and a port divider comprising a dividing wall configured to create a plurality of passages within an intake port of the main chamber;

aligning slots of the inner tube with apertures of the outer tube, thereby fluidly connecting a first passage of the port divider and the prechamber;

purging the prechamber by transporting fluid from an intake port of the main chamber to the prechamber through the first passage of the port divider; and misaligning the slots of the inner tube and the apertures of the outer tube by rotating the inner tube within the outer tube, thereby preventing the fluid from entering the prechamber.

15. The method according to claim 14, wherein purging the prechamber comprises transporting residual gas from the prechamber to the main chamber through a plurality of nozzles of the prechamber.

16. The method according to claim 14, wherein aligning the slots of the inner tube with apertures of the outer tube comprises controlling rotation of the inner tube within the outer tube by a camshaft assembly.

17. The method according to claim 14, wherein aligning the slots of the inner tube with apertures of the outer tube comprises controlling rotation of the inner tube within the outer tube by an electric motor.

18. The method according to claim 14, further comprising aligning the slots of the inner tube with apertures of the outer tube during an intake stroke of the engine cylinder.

19. The method according to claim 14, further comprising misaligning the slots of the inner tube with apertures of the outer tube during a power stroke of the engine cylinder.

20. The method according to claim 14, further comprising misaligning the slots of the inner tube with apertures of the outer tube during a compression stroke of the engine cylinder.

* * * * *